US007325428B2

(12) United States Patent
Bruggink

(10) Patent No.: US 7,325,428 B2
(45) Date of Patent: Feb. 5, 2008

(54) LOCATION AND IDENTIFICATION OF A TOOL IN A TOOL RECEIVING PART

(75) Inventor: Gerrit Bruggink, Hengelo (NL)

(73) Assignee: Wila B.V., CZ Lochem (NL)

( * ) Notice: Subject to any disclaimer, the term of this patent is extended or adjusted under 35 U.S.C. 154(b) by 236 days.

(21) Appl. No.: 11/134,346

(22) Filed: May 23, 2005

(65) Prior Publication Data

US 2005/0268680 A1 Dec. 8, 2005

(30) Foreign Application Priority Data

May 24, 2004 (EP) ..... 04076503

(51) Int. Cl.
*G01B 7/04* (2006.01)
*B21D 37/04* (2006.01)

(52) U.S. Cl. ..... 72/15.1; 72/389.3; 72/481.1

(58) Field of Classification Search ..... 72/15.1, 72/389.1, 389.3, 389.6, 414, 462, 466.8, 72/481.1, 481.6, 481.91, 481.93, 481.92
See application file for complete search history.

(56) References Cited

U.S. PATENT DOCUMENTS 4,616,322 A * 10/1986 Niwa et al. ..... 700/179
5,245,854 A * 9/1993 Bruggink et al. ..... 72/462
6,452,158 B1 * 9/2002 Whatley et al. ..... 250/231.13
6,456,054 B1 9/2002 Kataoka
6,494,075 B1 * 12/2002 Pelech, Jr. ..... 72/389.3
6,516,649 B1 * 2/2003 Mika et al. ..... 72/466.8
6,526,793 B1 * 3/2003 Danko et al. ..... 72/389.1
7,065,994 B1 * 6/2006 Danko et al. ..... 72/389.1
7,168,286 B1 * 1/2007 Pelech ..... 72/482.92
2002/0166360 A1 11/2002 Runk et al.
2003/0019272 A1 1/2003 Harrington et al.
2005/0268689 A1 * 12/2005 Erhardt et al. ..... 72/701

FOREIGN PATENT DOCUMENTS

DE 38 30 488 A1 3/1990
EP 1 410 854 A1 4/2004
JP 61-270053 A 11/1986
WO WO 2004/002650 A1 1/2004

* cited by examiner

*Primary Examiner*—David B Jones
(74) *Attorney, Agent, or Firm*—Harness, Dickey & Pierce, P.L.C.

(57) ABSTRACT

The invention relates to a combination of at least one tool and at least one tool receiving part having an elongated body comprising location means for at least in longitudinal direction locating the at least one tool in the elongated body. The combination delivers information to the manufacturing process such that adjusting of the machines can be automated.

19 Claims, 7 Drawing Sheets

LOCATION AND IDENTIFICATION OF A TOOL IN A TOOL RECEIVING PART

The invention relates to a combination of at least one tool and at least one tool receiving part having an elongated body. Such combinations are for example known from press brakes which comprise an elongated press brake clamping system in which a number of tools are clamped and with which for example metal sheets can be bent into, for example, boxes.

The tools can be placed manually into the machine. The location and type of a tool are in this respect important in order to be able to produce the desired product.

The location and identification of the tools are also important in order to determine the sequence of the tools, with which information the machine is adjusted. For example with a press brake the curvature of the tool receiving part is adjusted depending on the position and the type of the tools. Also, stops necessary for completing a product with the machine are adjusted accordingly.

In the case of a press brake, machines are often provided with control units in order to automate the process. In the case of a press brake the press brake system is coupled to a control unit and a robot which manipulates the metal sheet such that a complete product can be bent automatically. In such a case it is necessary that the tools are arranged at known locations on the press brake in the elongated tool receiving part. So in order to automate the entire machining process it is necessary to enter the exact locations of the tools in the tool receiving part into the control unit which controls the complete process. Doing this by hand is very labour intensive as the locations have to be measured with a high accuracy and then entered into the control unit.

DE-A-38 30 488 describes a combination of at least one tool and at least one tool receiving part. In the tool receiving part reading heads are arranged, which can read out an identification chip present in the tool. The reading heads are statically arranged on discrete positions along the elongate body. Furthermore a sensor strip is arranged, which can determine the clamping length based on the pressures exerted on the sensor strip. This document does not disclose any means for locating a tool in the elongated body of a tool receiving part.

WO-A-2004/002650 discloses a combination of at least one tool and a tool receiving part. Location means are provided for locating a tool in the elongated body of the tool receiving part. These locating means comprise a movable carrier on which a sensor is arranged. This carrier is moved along the different tools and the location of the tools is determined based on the position of the carrier in which the tool is detected. Also identification chips are provided in the tools such that the combination can both detect the location of the tool and the kind of tool present on that specific location. The moving parts, necessary for the location means, increase the sensitivity for failures and errors in determining the location of a tool. Especially in the environment in which such combinations are used, there is a risk that the functioning of the location means is endangered by dirt.

It is an object to provide a combination according to the preamble in which the above-mentioned disadvantages are alleviated.

This object is achieved by a combination which comprises static location means for at least in longitudinal direction locating the at least one tool in the at least one tool receiving part having an elongated body. The location means can send the detected position to the control unit which controls the entire process.

By using static location means the location of any tool can be determined instantly and is not dependent on the movement of any part of the location means. It also provides for a more robust and substantially maintenance free system as static parts are in general less sensitive to failure than moving parts.

In an embodiment of the combination according to the invention the at least one tool comprises an electrical identification circuit for identifying each tool. This identification circuit makes it possible for the control unit to distinguish the different tools arranged in the tool receiving part. The electrical identification circuit can also contain specific data for the tool, which can be read by the control unit or control means and used in order to determine how to control the combination.

In a preferred embodiment of the combination according to the invention it comprises an electrical conducting strip extending over substantially the full length of the receiving part and the at least one tool comprises an electrical connector for connection with the electrical conducting strip. This enables a direct contact between the tool and the location means. The electrical conducting strip can be used as a databus over which data can be exchanged between the tool and the location means.

In another preferred embodiment of the combination according to the invention the electrical conducting strip comprises semi-conducting material and the at least one tool comprises a circuit for measuring a voltage on the electrical conducting strip and communication means for communicating the measured voltage to the location means. By providing a current on the electrical conducting strip, the voltage will decrease over the length of the strip. The voltage at a specific position can be measured by a circuit present in the tool and this measured voltage can then be sent to the location means, which can determine, based on the voltage, what the location is of the respective tool.

In another combination according to the invention the location means sends a pulse train over the electrical conducting strip and the at least one tool comprises a circuit for measuring the delay of the pulse train and communication means for communicating the measured delay to the location means. Using a pulse train is very robust as it does not depend on any resistances in the connections between tools and the electrical conducting strip.

In a combination according to the invention the location means sends a signal over the electrical conducting strip with a certain frequency. Due to the impedance of the tool the frequency will be altered, which is an indication of the position of the tool. Instead of an electrical conducting strip and a signal with a frequency a fibre optic cable can be used, which is deformed by the tool. This deformation induces an alteration of the light wave in the fibre optic cable, which again is an indication for the position of the tool.

In yet another embodiment according to the invention the tool receiving part comprises location marks and the at least one tool comprises detection means for detecting the location marks and communication means for communicating the detected location mark to the location means.

These location marks can be an absolute address corresponding to an absolute location or a combination of an absolute address with a low resolution and an incremental location mark for providing the required resolution. These location marks can for example be detected by a light, but can also be for example an electrical location mark.

In a preferred embodiment of the combination according to the invention the tool receiving part comprises a support surface for transferring a force from the tool receiving part to the tool and clamping means having at least one clamping surface for clamping the tool in the tool receiving part against the clamping surface, wherein the electrical conducting strip is arranged at the clamping surface. Preferably the support surface and the clamping surface are perpendicular. If the conducting strip were to be arranged in the support surface, it should be resistant to large transfer forces, which are used to, for example, bend metal sheets. So, by arranging the conducting strip in the clamping surface a more reliable connection between the tool and the tool receiving part can be achieved.

In a very preferred embodiment according to the invention the combination is part of a press brake, wherein the at least one tool is a press brake tool and wherein the tool receiving part is a press brake clamping system.

A further embodiment according to the invention comprises discrete conducting capacitor surfaces arranged regularly along the elongated body and discrete contact surfaces arranged regularly along the elongated body, wherein the at least one tool comprises a contact for connecting the identification circuit to a discrete contact surface and wherein each discrete conducting capacitor surface and each discrete contact surface is connected to a processor with this embodiment the locating of a tool is based on measuring the capacity between the tool itself and the conducting capacitor surfaces, which are overlapped by the tool. The contact surfaces provide the connection to the identification circuit, but also provide a rough estimate of the location of the tool. The capacity and other functional dimensions (e.g. length and height) of the tool are stored in the tool itself or at another location and by comparing these with the measured capacity between the conducting capacitor surfaces, the exact location of the tool can be established by the location means.

Preferably each discrete contact surface is related to a single conducting capacitor surface.

In yet another embodiment of the invention, the combination comprises discrete conducting capacitor surfaces arranged regularly along the elongated body, wherein each discrete conducting capacitor surface is connected to a processor to identify and to locate a tool in the elongate body. In this embodiment the discrete conducting capacitor surfaces are used both for locating a tool and to identify a tool. The advantage is that the identification of the tool and the communication with the identification circuit present in the tool is performed without any physical contact.

In another embodiment the capacitor surfaces are rectangular and parallel to the longitudinal direction. By a partial overlap of a tool and a rectangular capacitor surface, the measured capacity is substantially linear to the position of the tool relative to the capacitor surface.

In another embodiment the capacitor surfaces overlap adjacent capacitor surfaces seen in a direction perpendicular to the longitudinal direction. This provides for a constant measurement precision over the full length. With rectangular capacitor surfaces, there is always a small distance between two surfaces necessary, which can influence the precision of the measurement.

These and other advantages of the invention will be elucidated in conjunction with the accompanying drawings.

Figure 1:
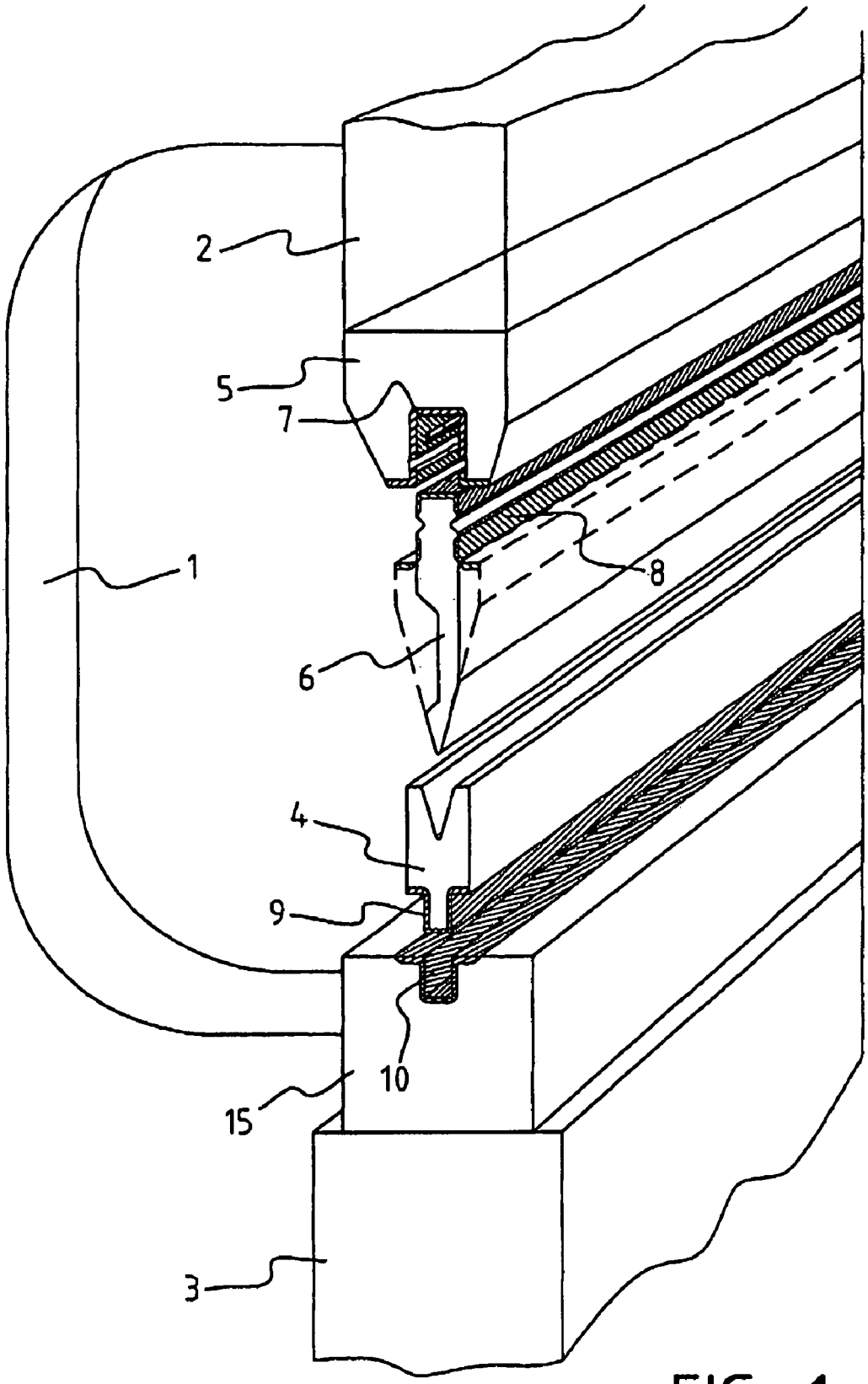
FIG. 1 shows a perspective view of a press brake comprising an embodiment of a combination according to the invention.

FIG. 1 shows a press brake 1 having an upper beam 2 and a lower beam 3. The lower beam 3 comprises a clamping system and tool receiving part 15 for a lower tool 4 and the upper beam 2 has a clamping system and tool receiving part 5 for clamping an upper tool 6.

Figure 2A:
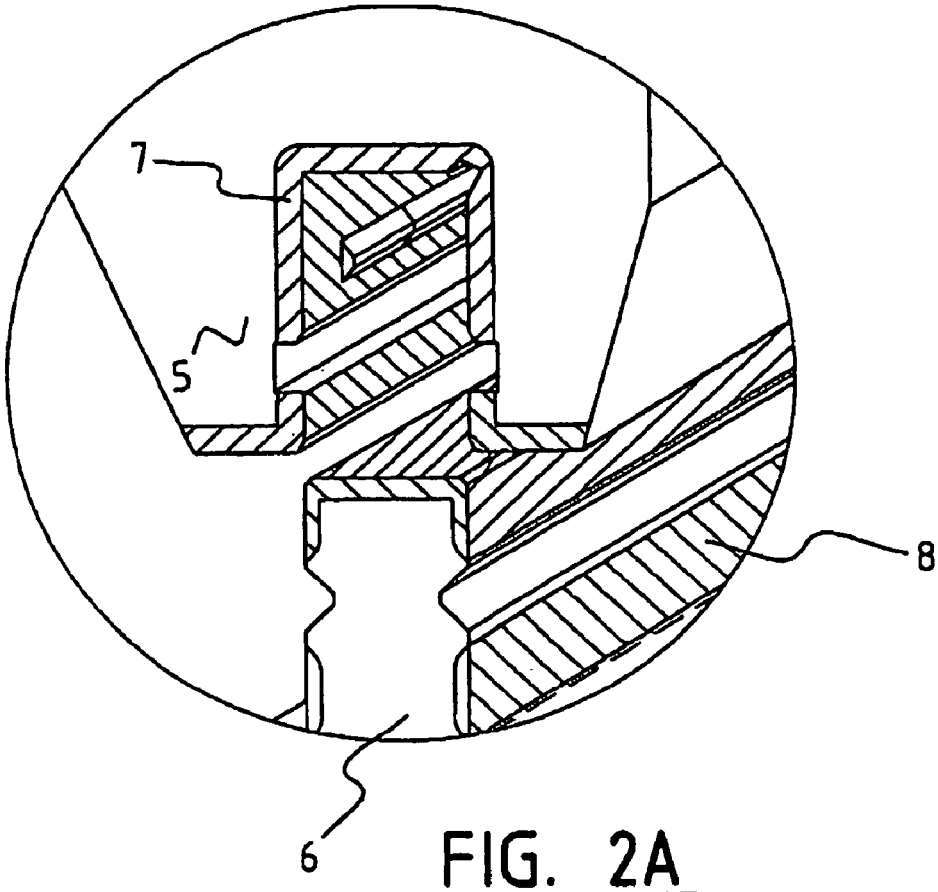
FIGS. 2A and 2B show partial enlargements of FIG. 1.

The clamping system and tool receiving part 5 (see also FIG. 2A) has an electrical conducting strip 7. The tool 6 has an connector 8, which in the FIG. 1 is shown as an over its length extending strip. It can also be a small connector for example comprising a little extending pin.

Figure 2B:
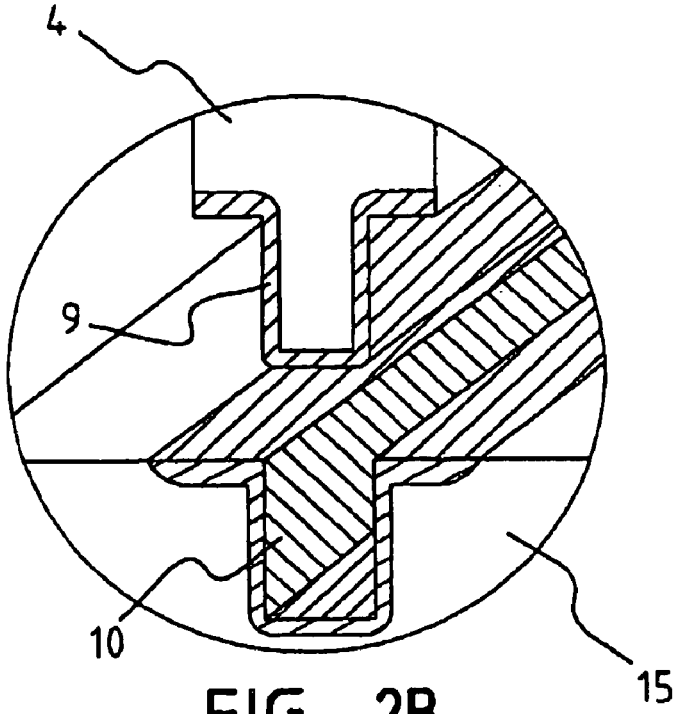

The lower tool 4 (see also FIG. 2B) is also provided with a connector 9, which makes contact with an electrical conducting strip 10 arranged in the clamping system and tool receiving part 15.

Figure 3:
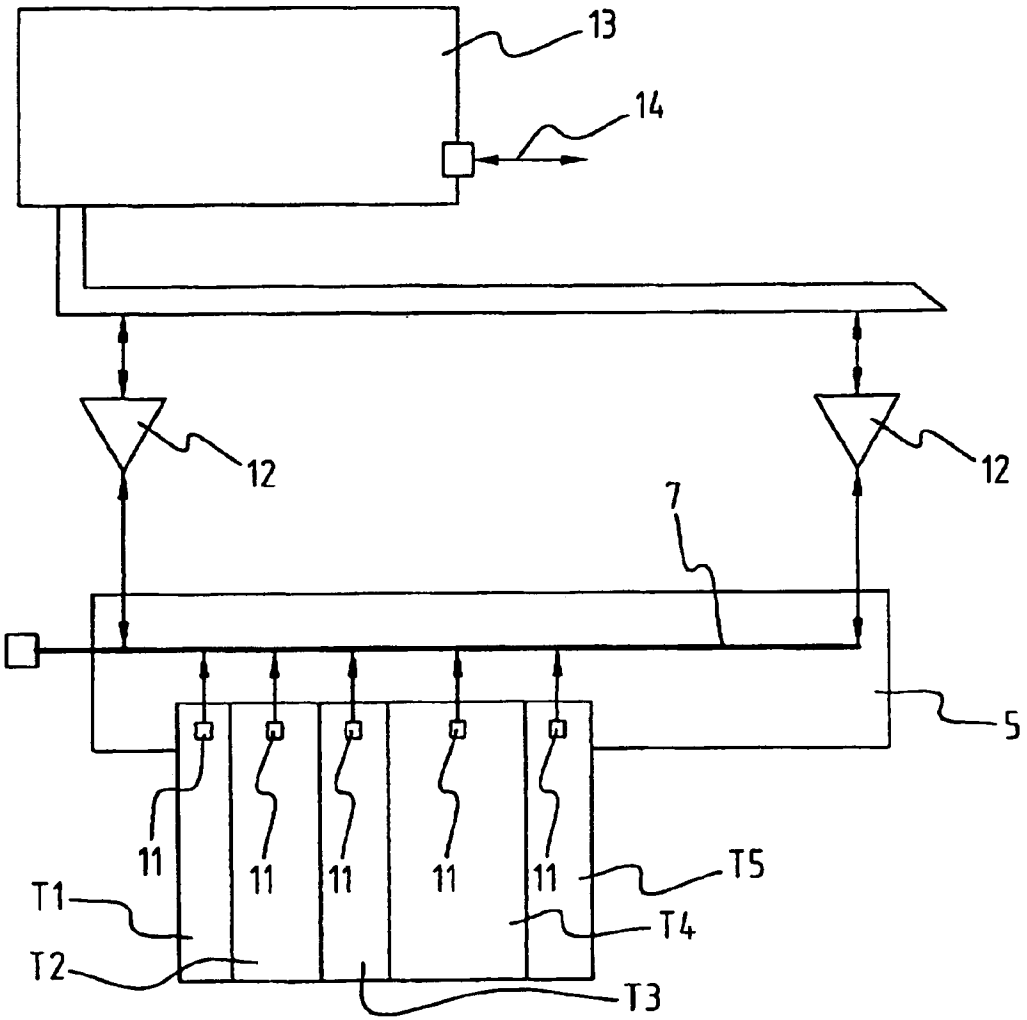
FIG. 3 shows a schematic overview of the upper beam and of the location means of an embodiment according to the invention.

In FIG. 3 a schematic overview of the upper beam and of the location means of the embodiment according to the invention is shown. A number of tools T1, T2, T3, T4, T5 are arranged in a clamping system and tool receiving part 5. This tool receiving part 5 comprises an electrical conducting strip 7. Each tool T1, T2, T3, T4, T5 comprises an electrical circuit 11, which is in electrical contact with the electrical conducting strip 7.

The electrical conducting strip 7 functions as a databus which is driven by bus drivers 12 and communicates with the interface 13. The electrical circuit 11 comprises for example identification means with which the interface 13 can identify each separate tool T1, T2, T3, T4, T5. In the case the electrical conducting strip 7 is a semi-conductor, the circuit 11 will measure the local voltage and communicates this value through the databus and the bus drivers 12 to the interface 13. Based on the measured voltage the location means can determine at which position each separate tool is arranged in the clamping system and tool receiving part 5.

The interface 13 is furthermore connected through a data line 14 with for example a control unit, which controls the entire process.

Figure 4A:
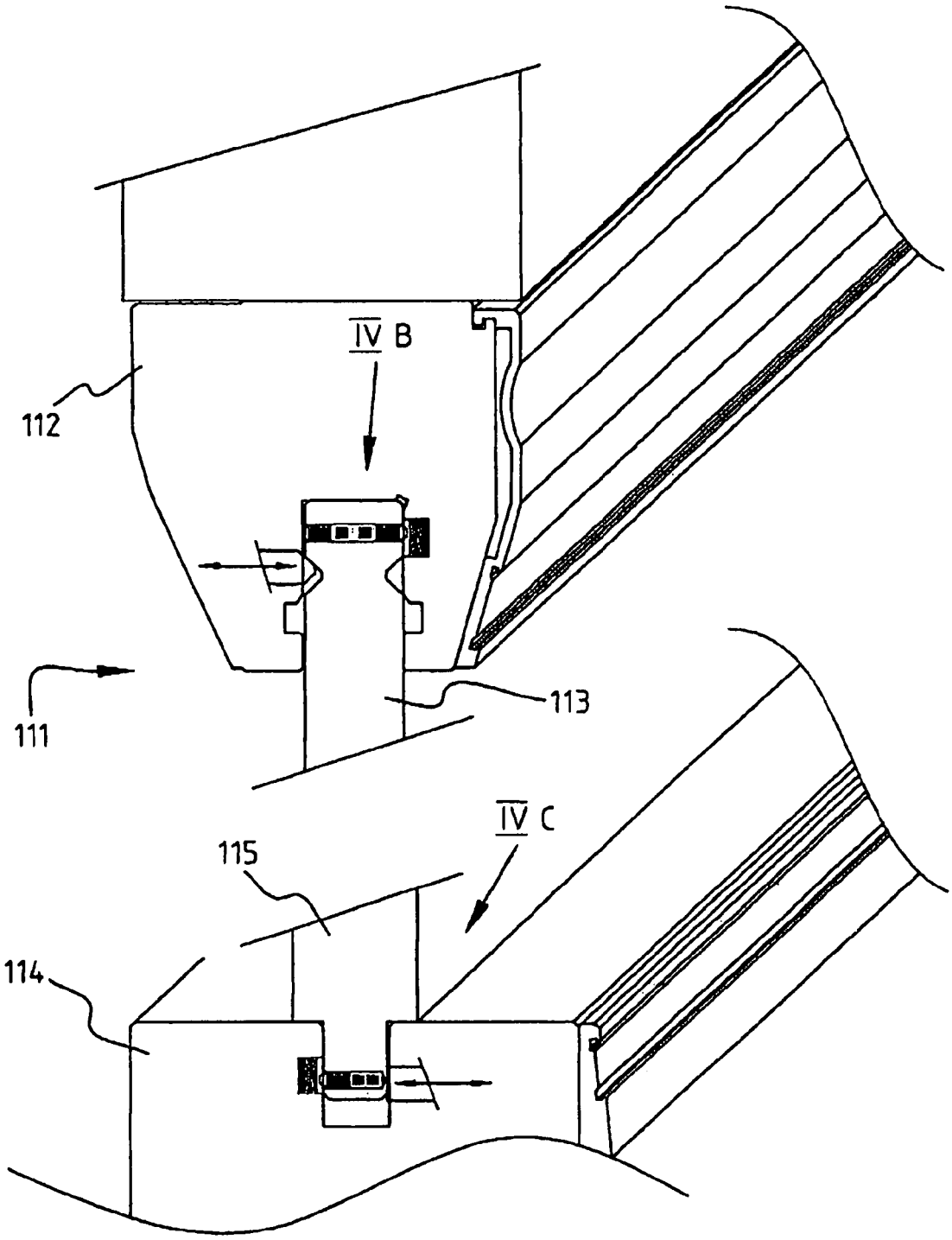
FIG. 4A-4C show a second embodiment of the invention.
Figure 4B:
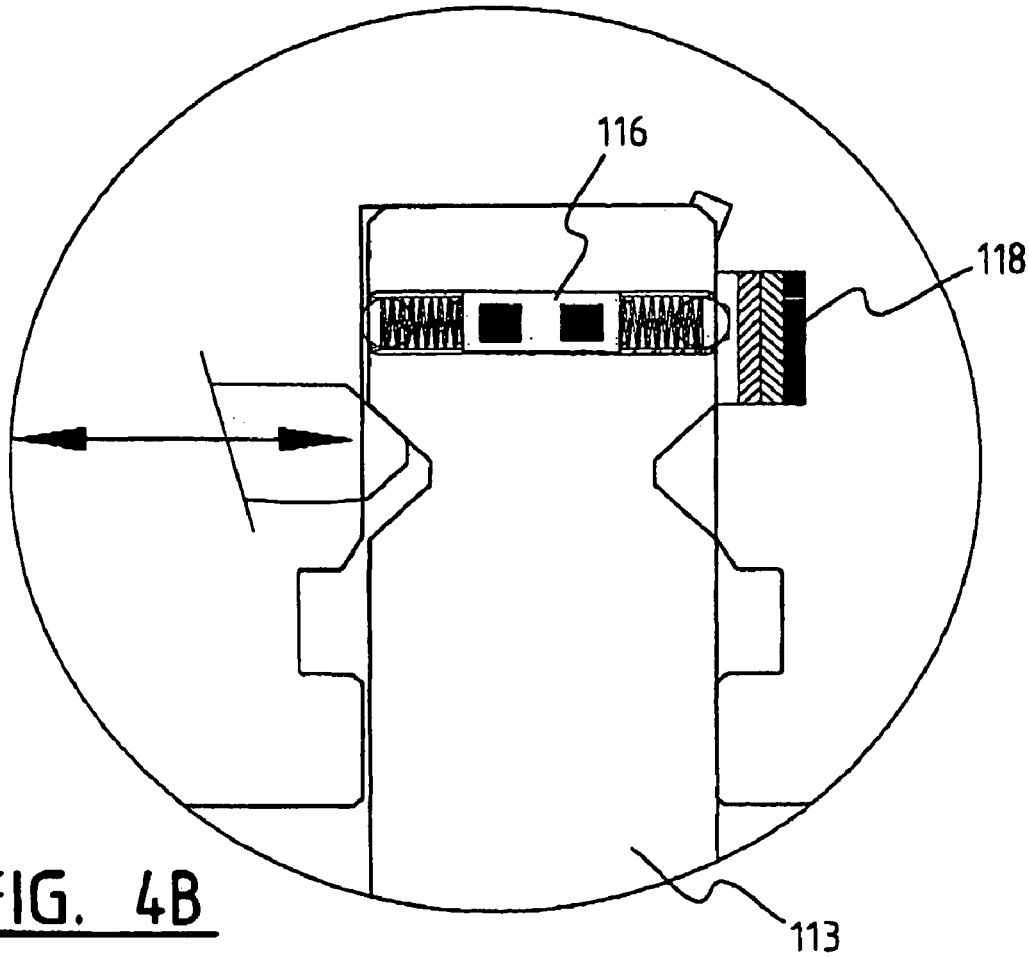
Figure 4C:
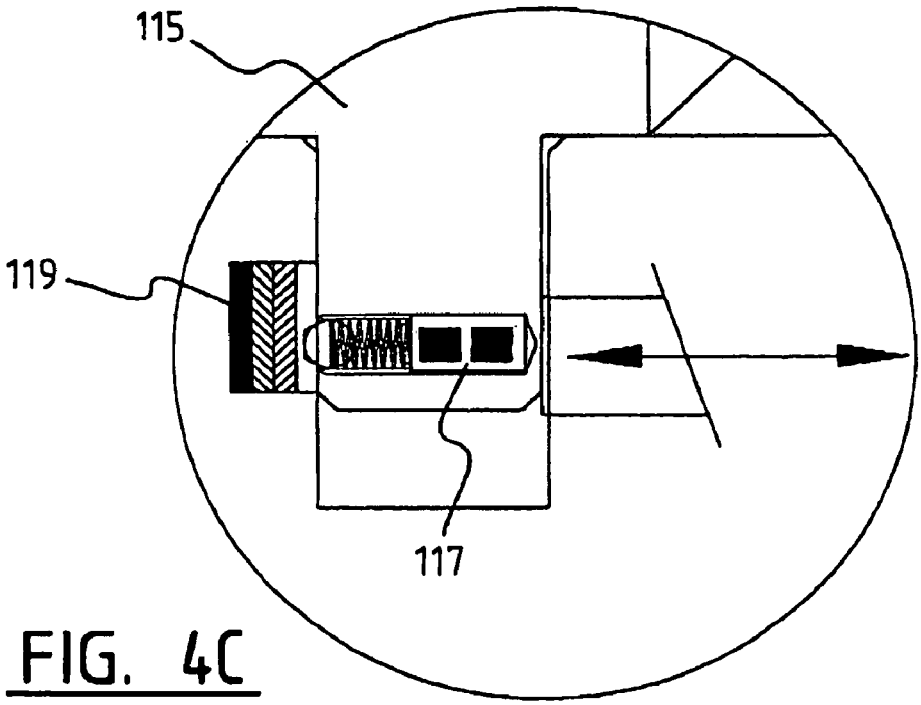

FIG. 4A shows a second embodiment of the invention 111. The press brake again has a clamping system and tool receiving part 112 for clamping an upper tool 113. The lower clamping system and tool receiving part 114 comprises a lower tool 115. Each tool 113, 115 (see also FIGS. 4B and 4C) comprises a contact pin 116, 117 for making a direct electrical contact between the tool 113, 115 with a contact surface 118, 119.

Figure 5:
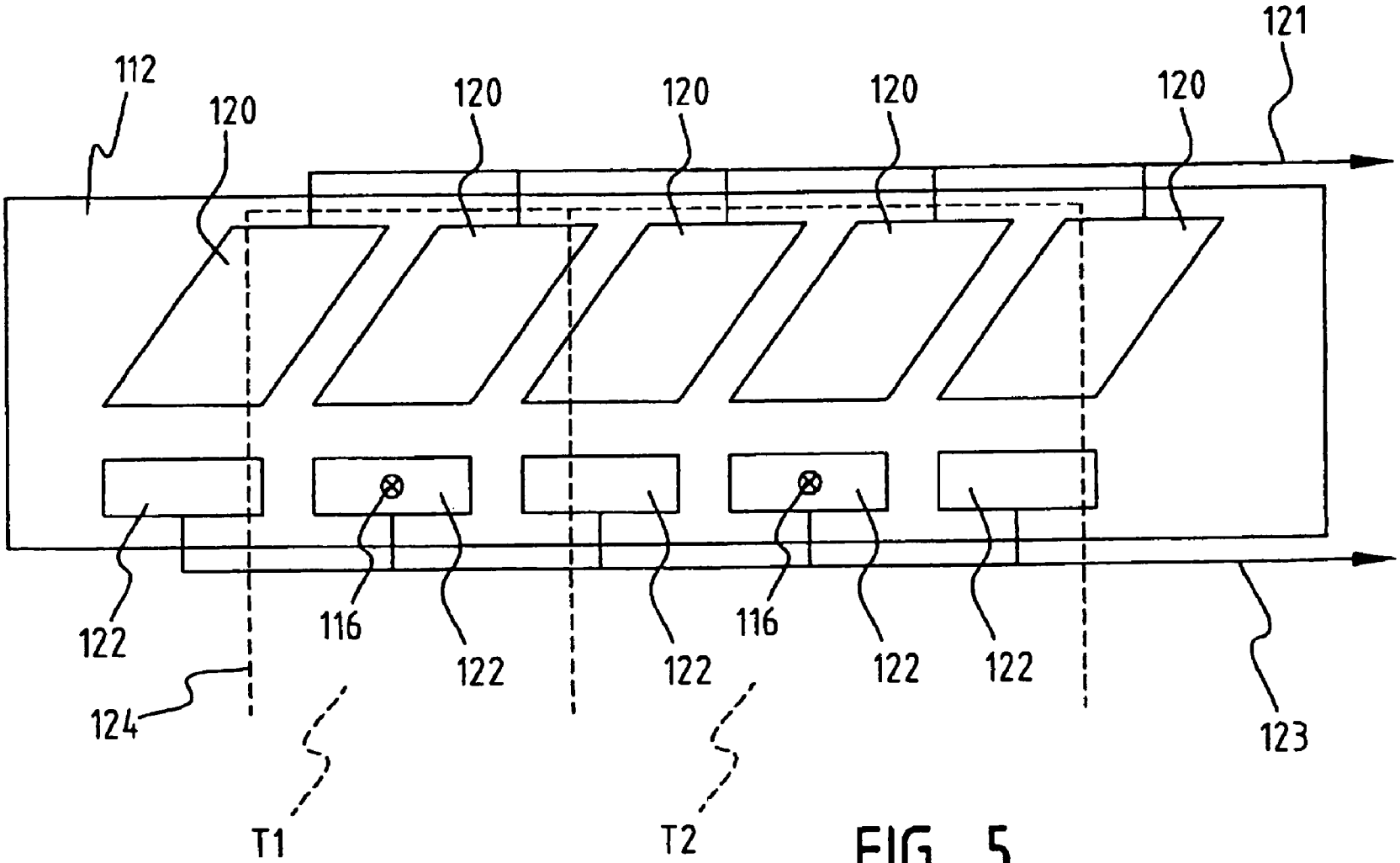
FIG. 5 shows a schematic overview of the embodiment according to FIG. 4.

In FIG. 5 a schematic overview of the embodiment according to FIG. 4 is shown.

Along the clamping system and tool receiving part 112 on the upper beam a number of discrete conducting capacitor surfaces 120 are arranged at regular intervals. Each of these capacitor surfaces 120 is connected to a processor through an electrical line 121. Each conducting capacitor surface 120 is related to a discrete contact surface 122 which are also regularly arranged along the clamping system and tool receiving part 112. Also these contact surfaces are connected to a processor through a line 123.

With dashed lines two tools T1 and T2 are shown. The tool T1 makes a direct contact via a contact pin 116 with a contact surface 122. Also tool T2 makes contact through a contact pin 116 to a contact surface 122.

Before using a tool T1, T2 some data is measured and stored in the processor or for example identification means. It is measured what the complete capacity of the tool is and what the distance of the contact pin 116 to a side 124 of the tool is.

When the tools T1 and T2 are placed into the clamping system and tool receiving part 112 the tools T1 and T2 make contact through their contact pins with the contact surfaces 122. So it is known to the processor around at least which contact surfaces and corresponding capacitor surfaces the tools T1 and T2 are present. When both tools T1 and T2 need to be abuttingly arranged, one can detect by measuring the complete capacity of both tools and comparing that with the stored sum of the capacities whether both tools are arranged abuttingly or a small space is present between the two tools.

When it is detected that both tools are abuttingly arranged, one can determine the position of the set of tools T1, T2. Taking an outer tool, for example T1, one knows by the stored dimensions of the tools, which capacitor surfaces are overlapped by the tools. Now taking the capacitor surface 120, which is just partially overlapped by the side 124 of the tool T1, one measures the detected capacity of this specific capacitor surface. As the measured capacity is only a part of the full capacity possible with this surface 120, one can determine the percentage of overlap of the tool T1 with respect to this surface and then determine what the exact position is relative to the clamping system and tool receiving part 112. As the length of a tool T1 is known, one can also determine the exact location of the tool T2. In this way one can determine the specific location of each tool.

Figure 6:
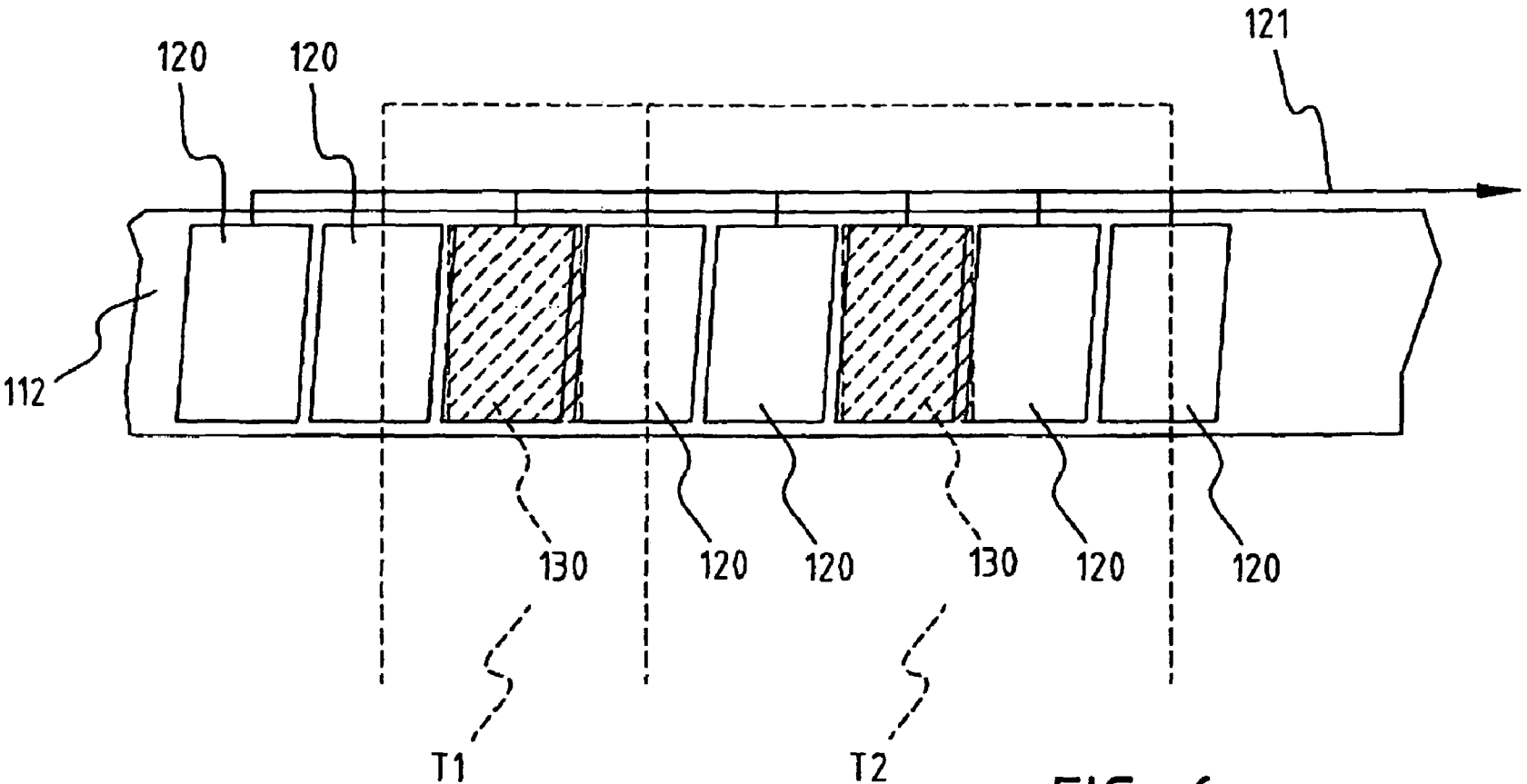
FIG. 6 shows a schematic overview of a third embodiment according to the invention.

FIG. 6 shows a third embodiment in which similarly to the embodiment according to FIGS. 4 and 5 a number of discrete conducting capacitor surfaces 120 are arranged on the tool receiving part 112. Again two tools T1 and T2 are shown in dashed lines. With the discrete conducting capacitor surfaces 120 it is possible to detect the location of each tool T1, T2, as described above.

Each tool T1, T2 comprises an identification circuit 130 on which relevant data of the tool is stored. The discrete conductor capacitor surfaces 120 can be used for locating the tools T1 and T2, but can also be used to read out the electrical identification circuits 130. For this purpose the capacitor surfaces 120, which are connected via an electrical line 121 to a processor are used to read out the electrical identification circuit 130. Depending on the measurement to be performed, i.e. determination of the location or the identification of a tool, the capacitor surfaces 120 are connected to the relevant processing circuit to determine either the location or to identify the tool.

The invention claimed is:

1. Combination of at least one tool and at least one tool receiving part having an elongated body comprising static location means for, at least in a longitudinal direction, locating the at least one tool in the elongated body an electrical conducting strip extending over substantially the full length of the at least one tool receiving part, and the at least one tool comprising an electrical connector for connection with the electrical conducting strip.

2. Combination according to claim 1, wherein the at least one tool comprises an electrical identification circuit for identifying each tool.

3. Combination according to claim 1, wherein the electrical conducting strip comprises semi-conducting material and wherein the at least one tool comprises a circuit for measuring a voltage on the electrical conducting strip and communication means for communicating the measured voltage to the location means.

4. Combination according to claim 1, wherein the location means sends a pulse train over the electrical conducting strip and wherein the at least one tool comprises a circuit for measuring the delay of the pulse train and communication means for communicating the measured delay to the location means.

5. Combination according to claim 1, wherein the tool receiving part comprises location marks and wherein the at least one tool comprises detection means for detecting the location marks and communication means for communicating the detected location mark to the location means.

6. Combination according to claim 1, wherein the tool receiving part comprises a support surface for transferring a force from the receiving part to the tool and clamping means having at least one clamping surface for clamping the tool in the receiving part against the clamping surface, wherein the electrical conducting strip is arranged at the clamping surface.

7. Combination according to claim 6, wherein the support surface and clamping surface are perpendicular.

8. Combination according to claim 1, wherein the combination is part of a press brake, wherein the at least one tool is a press brake tool and wherein the at least one tool receiving part is a press brake clamping system.

9. Combination of at least one tool and at least one tool receiving part having an elongated body comprising static location means for, at least in a longitudinal direction, locating the at least one tool in the elongated body, the at least one tool comprising an electrical identification circuit for identifying each tool, wherein discrete conducting capacitor surfaces are arranged regularly along the elongated body and discrete contact surfaces are arranged regularly along the elongated body, the at least one tool comprising a contact for connecting the identification circuit to a discrete contact surface, wherein each discrete conducting capacitor surface and each discrete contact surface is connected to a processor.

10. Combination according to claim 9, wherein each discrete contact surface is related to a single conducting capacitor surface.

11. Combination according to claim 10, wherein the capacitor surfaces are rectangular and parallel to the longitudinal direction.

12. Combination according to claim 10, wherein the capacitor surfaces overlap adjacent capacitor surfaces seen in a direction perpendicular to the longitudinal direction.

13. Combination according to claim 9, wherein the capacitor surfaces are rectangular and parallel to the longitudinal direction.

14. Combination according to claim 9, wherein the capacitor surfaces overlap adjacent capacitor surfaces seen in a direction perpendicular to the longitudinal direction.

15. Combination of at least one tool and at least one tool receiving part having an elongated body comprising static location means for, at least in a longitudinal direction, locating the at least one tool in the elongated body, the at least one tool comprising an electrical identification circuit for identifying each tool, wherein discrete conducting capacitor surfaces are arranged regularly along the elongated body, each discrete conducting capacitor surface being connected to a processor to identify and to locate a tool in the elongated body.

16. Combination of at least one tool and at least one tool receiving part having an elongated body comprising static location means for, at least in a longitudinal direction, locating the at least one tool in the elongated body, wherein a fibre optic cable extends over substantially the full length of the at least one tool receiving part, the at least one tool comprising an optical fibre contact area for deformation of the optical fibre.

17. Combination according to claim 16, comprising an electrical conducting strip extending over substantially the full length of the receiving part and wherein in the least one tool comprises an electrical connector for connection with the electrical conducting strip.

18. Combination according to claim 16, wherein the combination is part of a press brake, wherein the at least one tool is a press brake tool and wherein the at least one tool receiving part is a press brake clamping system.

19. Combination of at least one tool and at least one tool receiving part having an elongated body comprising static location means for, at least in a longitudinal direction, locating the at least one tool in the elongated body, the at least one tool comprising an electrical identification circuit for identifying each tool, wherein a fibre optic cable extends over substantially the full length of the at least one tool receiving part, the at least one tool comprising an optical fibre contact area for deformation of the optical fibre.

* * * * *